US010450902B2

(12) United States Patent
Brune et al.

(10) Patent No.: US 10,450,902 B2
(45) Date of Patent: Oct. 22, 2019

(54) FINGER FOLLOWER ASSEMBLY FOR USE IN A VALVETRAIN OF AN INTERNAL COMBUSTION ENGINE

(71) Applicant: GT Technologies, Westland, MI (US)

(72) Inventors: John Edmund Brune, Stockbridge, MI (US); Scott Paul Smith, Grass Lake, MI (US)

(73) Assignee: GT Technologies, Westland, MI (US)

( * ) Notice: Subject to any disclaimer, the term of this patent is extended or adjusted under 35 U.S.C. 154(b) by 0 days.

(21) Appl. No.: 15/824,050

(22) Filed: Nov. 28, 2017

(65) Prior Publication Data

US 2018/0156077 A1 Jun. 7, 2018

Related U.S. Application Data

(60) Provisional application No. 62/429,142, filed on Dec. 2, 2016.

(51) Int. Cl.

| | |
|---|---|
| ***F01L 1/14*** | (2006.01) |
| ***F01L 1/18*** | (2006.01) |
| ***F01L 1/24*** | (2006.01) |

(52) U.S. Cl.

CPC ..... *F01L 1/182* (2013.01); *F01L 1/185* (2013.01); *F01L 1/2416* (2013.01); *F01L 2105/00* (2013.01); *F01L 2105/02* (2013.01)

(58) Field of Classification Search

CPC ..... F01L 1/182; F01L 1/185; F01L 1/2416; F01L 2105/00; F01L 2105/02

See application file for complete search history.

(56) References Cited

U.S. PATENT DOCUMENTS 5,931,133 A 8/1999 Giannone et al.
6,302,075 B1 10/2001 Krieg et al.
(Continued)

FOREIGN PATENT DOCUMENTS

DE 19742778 A1 4/1999
EP 1267043 A1 12/2002
(Continued)

OTHER PUBLICATIONS

Communication dated Apr. 6, 2018 enclosing the Extended European Search Report dated Mar. 26, 2018 for European Application No. 18151900.0.

*Primary Examiner* — Zelalem Eshete
(74) *Attorney, Agent, or Firm* — Howard & Howard Attorneys PLLC

(57) ABSTRACT

A finger follower for use in an internal combustion engine valvetrain having a valve, a lash adjuster, and a camshaft having a lobe. The finger follower includes a shaft, a bearing rotatably supported by the shaft for engaging the lobe. A body is provided with a pad for engaging the valve, a socket spaced from the pad for engaging the lash adjuster, and walls disposed between the pad and the socket. A slot is formed in each wall for supporting the shaft, and each has a respective pair of eccentric arc-shaped bearing surfaces arranged to allow the shaft to rotate within the slots and to move along the slots to facilitate alignment of the bearing with respect to engagement with the lobe independent of alignment of the pad with respect to engagement with the valve and of alignment of the socket with respect to engagement with the lash adjuster.

9 Claims, 18 Drawing Sheets

(56) References Cited

U.S. PATENT DOCUMENTS

| | | | | |
|---|---|---|---|---|
| 2006/0120651 | A1 | 6/2006 | Ochi | |
| 2010/0139589 | A1 | 6/2010 | Kim et al. | |
| 2015/0167512 | A1* | 6/2015 | Kim | F01L 13/0063 123/90.16 |
| 2015/0233267 | A1 | 8/2015 | Dupke | |

FOREIGN PATENT DOCUMENTS

| | | | |
|---|---|---|---|
| JP | 2006138373 | A | 6/2006 |
| JP | 2008115818 | A | 5/2008 |
| JP | 2009079569 | A | 4/2009 |
| JP | 2013029027 | A | 2/2013 |
| WO | 2014053124 | A1 | 4/2014 |

* cited by examiner

54

FINGER FOLLOWER ASSEMBLY FOR USE IN A VALVETRAIN OF AN INTERNAL COMBUSTION ENGINE

CROSS-REFERENCE TO RELATED APPLICATIONS

The present application claims priority to and all the benefits of U.S. Provisional Patent Application No. 62/429,142, filed on Dec. 2, 2016, which is hereby expressly incorporated herein by reference in its entirety.

BACKGROUND OF THE INVENTION

1. Field of Invention

The present invention relates, generally, to engine valvetrain systems and, more specifically, to a finger follower assembly for use in a valvetrain of a cylinder head of an internal combustion engine.

2. Description of the Related Art

Conventional engine valvetrain systems known in the art typically include one or more camshafts in rotational communication with a crankshaft supported in a block, one or more intake and exhaust valves supported in a cylinder head, and one or more intermediate members for translating radial movement from lobes of the camshaft into linear movement of the valves. The valves are used to regulate the flow of gasses in and out of cylinders of the block. To that end, the valves each have a head and a stem extending therefrom. The valve head is configured to periodically seal against the cylinder head. To this end, a compression spring is typically supported in the cylinder head, is disposed about the valve stem, and is operatively attached to the valve stem via a spring retainer. The valve stem is typically supported by a valve guide that is also operatively attached to the cylinder head, whereby the valve stem extends through the valve guide and travels therealong in response to engagement from the intermediate member.

As the camshaft rotates, the intermediate member translates force from the lobes into linear movement of the valve between different positions. The two most conventional valve positions are commonly referred to as "valve open" and "valve closed". In the valve closed position, potential energy from the loaded spring holds the valve head sealed against the cylinder head. In the valve opened position, the intermediate member translates linear movement to compress the spring, thereby un-sealing the valve head from the cylinder head so as to allow gasses to flow into (or, out of) the cylinder of the block.

During engine operation, and particularly at high engine rotational speeds, close tolerance must me maintained between the camshaft lobe, the intermediate member, and the valve stem. Excessive tolerance results in detrimental engine performance as well as increased friction and wear of the various valvetrain components, which leads to significantly decreased engine life. In order to maintain proper tolerances, in modern "overhead cam" valvetrain systems, the intermediate member is typically realized by a lash adjuster and a finger follower (sometimes referred to in the art as a "rocker arm finger follower"). The lash adjuster is typically supported in the cylinder head at a location spaced from the valve stem, with a lobe of the camshaft disposed above ("overhead of") the lash adjuster and the valve stem. Conventional lash adjusters utilize hydraulic oil pressure from the engine to maintain certain tolerances between the valve stem and the camshaft lobe under varying engine operating conditions, such as engine rotational speed or operating temperature. Thus, in operation, force from the camshaft lobe is translated through the finger follower to the lash adjuster and the valve stem. To that end, the finger follower has a body which extends between and engages the lash adjuster and the valve stem, and also includes a bearing that engages the camshaft lobe. The bearing is typically supported by a shaft fixed to the body of the finger follower. The bearing rotates on the shaft, follows the profile of the lobe of the camshaft, and translates force to the finger follower, via the shaft, so as to open the valve in response to rotation of and engagement with the camshaft lobe.

It will be appreciated that maintaining proper alignment between the rotational axis of the camshaft and the rotational axis of the bearing of the finger follower ensures smooth engagement between the bearing of the finger follower and the lobe of the camshaft in operation. While effecting and maintaining proper alignment is desirable for engine valvetrain systems, in some applications it is not readily achievable and/or practical. Thus, a certain amount of misalignment between valvetrain components is not uncommon in the art. Nevertheless, misalignment between the camshaft lobe and the bearing of the finger follower typically results in undesirable wear, increased noise, increased component stress and/or load, decreased component life, and the like to the various components of the valvetrain.

Similarly, it will be appreciated that proper alignment of the body of the finger follower with respect to the components of the valvetrain supported in the cylinder head, such as the lash adjuster and the valve, ensures proper operation of the finger follower in operation. Here too, misalignment between the body of the finger follower and the lash adjuster and/or valve typically results in undesirable wear, increased noise, increased component stress and/or load, decreased component life, and the like to the various components of the valvetrain.

Each of the components of an engine valvetrain system of the type described above must cooperate to effectively translate movement from the camshaft so as to operate the valves properly at a variety of engine rotational speeds and operating temperatures and, at the same time, maintain correct valvetrain tolerances. In addition, each of the components must be designed not only to facilitate improved performance and efficiency, but also so as to reduce the cost and complexity of manufacturing and assembling the valvetrain system, as well as reduce wear in operation. While engine valvetrain systems known in the related art have generally performed well for their intended purpose, there remains a need in the art for an engine valvetrain system that has superior operational characteristics, and, at the same time, reduces the cost and complexity of manufacturing the components of the system.

SUMMARY OF THE INVENTION

The present invention overcomes the disadvantages in the related art in a finger follower assembly for use in an internal combustion engine valvetrain. The valvetrain is provided with a valve, a lash adjuster, and a camshaft having a lobe. The finger follower assembly includes a shaft and a bearing rotatably supported by the shaft for engaging the lobe of the camshaft. The finger follower assembly also includes a body having a pad for engaging the valve, a socket spaced longitudinally from the pad for engaging the lash adjuster, a pair of walls spaced laterally from each other and disposed between the pad and the socket, and a slot formed in each of the walls for supporting the shaft. The slots each have a respective pair of eccentric arc-shaped bearing surfaces arranged to allow the shaft to rotate within the slots and to move along the slots so as to facilitate alignment of the bearing with respect to engagement with the lobe of the camshaft independent of alignment of the pad with respect to engagement with the valve and of alignment of the socket with respect to engagement with the lash adjuster.

In this way, the present invention significantly reduces the complexity and packaging size of the valvetrain system and its associated components. Moreover, the present invention reduces the cost of manufacturing valvetrain systems that have superior operational characteristics, such as improved engine performance, control, lubrication, efficiency, as well as reduced vibration, noise generation, engine wear, and packaging size.

BRIEF DESCRIPTION OF THE DRAWINGS

Other objects, features, and advantages of the present invention will be readily appreciated as the same becomes better understood after reading the subsequent description taken in connection with the accompanying drawings.

DETAILED DESCRIPTION OF THE INVENTION

Figure 1:
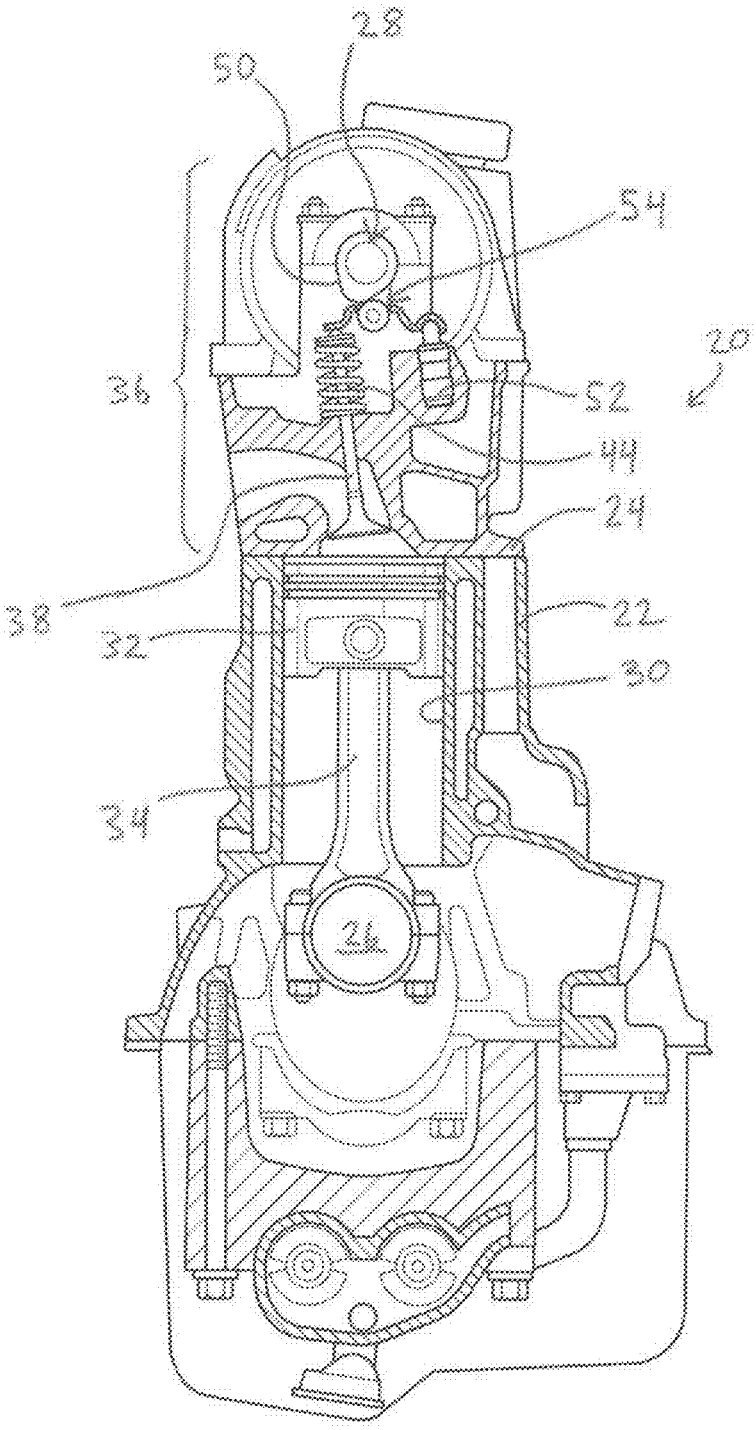
FIG. 1 is a partial front sectional view of an automotive engine with an overhead-cam configuration including a valvetrain mounted in a cylinder head.

Referring now to the drawings, where like numerals are used to designate like structure, a portion of an internal combustion engine is illustrated at 20 in FIG. 1. The engine 20 includes a block 22 and a cylinder head 24 mounted to the block 22. A crankshaft 26 is rotatably supported in the block 22, and a camshaft 28 is rotatably supported in the cylinder head 24. The crankshaft 26 drives the camshaft 28 via a timing chain or belt (not shown, but generally known in the art). The block 22 typically includes one or more cylinders 30 in which a piston 32 is supported for reciprocal motion therealong. The piston 32 is pivotally connected to a connecting rod 34, which is also connected to the crankshaft 26. In operation, combustion in the cylinders 30 of the engine 20 moves the pistons 32 in reciprocal fashion within the cylinders 30.

Reciprocal motion of the piston 32 generates rotational torque that is subsequently translated by the crankshaft 26 to the camshaft 28 which, in turn, cooperates with a valvetrain, generally indicated at 36, to control the flow and timing of intake and exhaust gasses between the cylinder head 24, the cylinders 30, and the outside environment. Specifically, the camshaft 28 controls what is commonly referred to in the art as "valve events," whereby the camshaft 28 effectively actuates valves 38 supported in the cylinder head 24 at specific time intervals with respect to the rotational position of the crankshaft 26, so as to effect a complete thermodynamic cycle of the engine 20. To that end, the valves 38 each have a head 40 and a stem 42 extending therefrom (see FIG. 2). The valve head 40 is configured to periodically seal against the cylinder head 24 adjacent the cylinder 30, such as with a compression spring 44 supported in the cylinder head 24, disposed about the valve stem 42, and operatively attached to the valve 38 via a retainer 46. The valve stem 42 is typically supported by a valve guide 48 that is also operatively attached to the cylinder head 24, whereby the valve stem 42 extends through the valve guide 48 and travels therealong in response to force translated via rotation of the camshaft 28 (see FIG. 2). To this end, the camshaft 28 has lobes 50 with a predetermined profile configured to cooperate with the valvetrain 36 such that radial movement from the camshaft 28 is translated into linear movement of the valves 38 so as to control the valve events, as discussed above.

Figure 2:
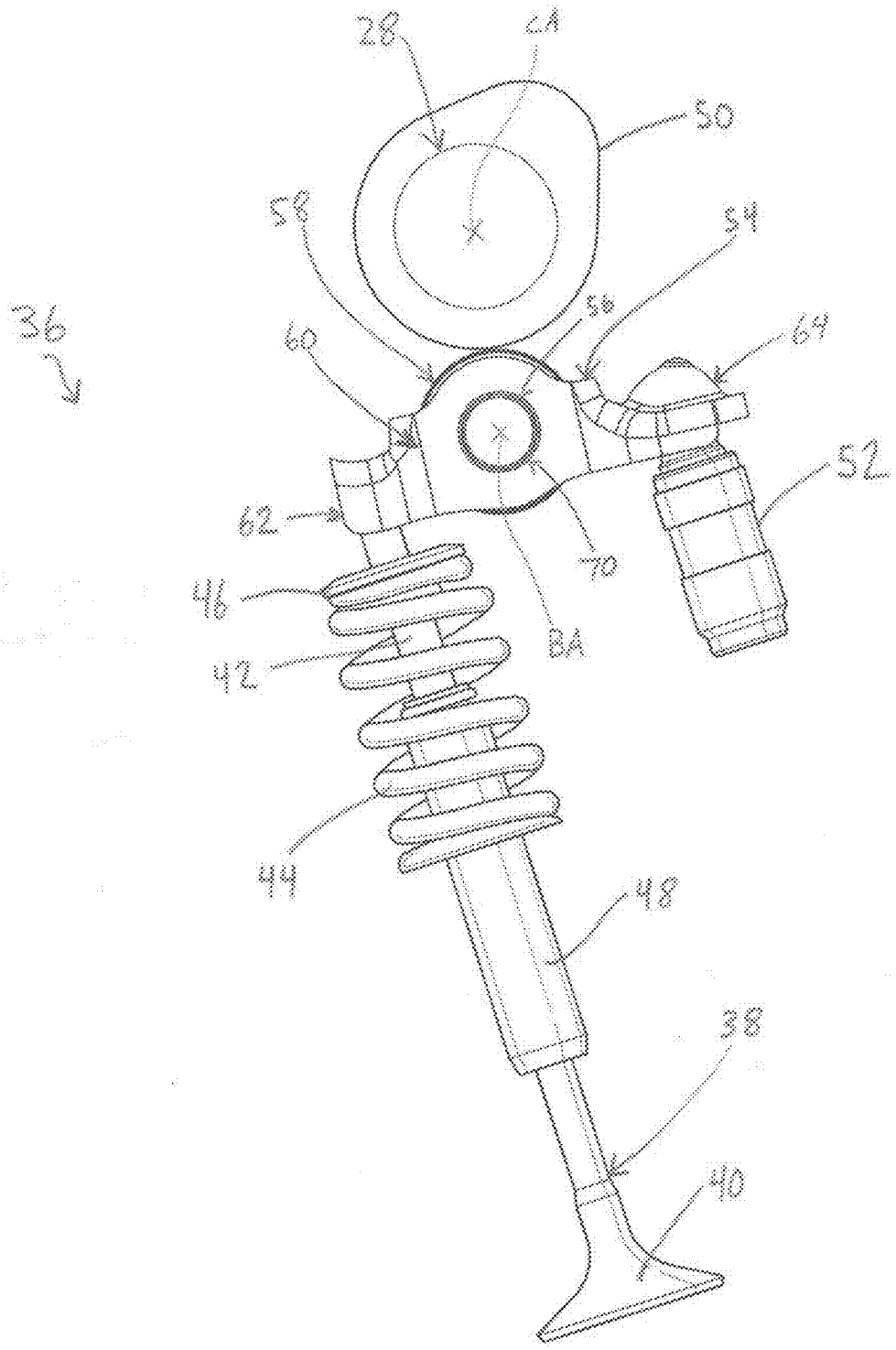
FIG. 2 is a front view of a portion of the valvetrain of FIG. 1 showing a valve, a camshaft, a lash adjuster, and a finger follower assembly according to one embodiment of the present invention.

With continued reference to FIGS. 1 and 2, the representative embodiment of the valvetrain 36 illustrated herein also includes a lash adjuster 52 and a finger follower assembly (sometimes referred to in the related art as a "rocker arm finger follower"), generally indicated at 54 and according to one embodiment of the present invention. Conventional lash adjusters 52 utilize hydraulic oil pressure from the engine 20 to maintain tolerances between the valve stem 42 and the camshaft lobe 50 under varying engine operating conditions, such as engine rotational speed or operating temperature. To that end, the lash adjuster 52 is supported in the cylinder head 24, is spaced from the valve stem 42, and cooperates with the finger follower assembly 54 to effect translation of force to the valve 38, as will be described in greater detail below. While the lash adjuster 52 shown in FIGS. 1 and 2 is a hydraulic lash adjuster, it will be appreciated that the lash adjuster 52 could be of any suitable type or configuration without departing from the scope of the present invention.

Those having ordinary skill in the art will recognize the valvetrain 36 described herein as what is commonly referred to as an "overhead cam" configuration, whereby rotation of the camshaft 28 is translated to the finger follower assembly 54 which, in turn, engages and directs force to the valve 38 and the lash adjuster 52. While the engine 20 illustrated in FIG. 1 is an inline-configured, single overhead cam, spark-ignition, Otto-cycle engine, those having ordinary skill in the art will appreciate that the engine 20 could be of any suitable configuration, with any suitable number of cylinder heads 24 and/or camshafts 28 disposed in any suitable way, controlled using any suitable thermodynamic cycle, and with any suitable type of valvetrain 36, without departing from the scope of the present invention. By way of non-limiting example, the engine 20 could be a so-called "dual overhead-cam V8" with an eight-cylinder V-configured block 22 and a pair of cylinder heads 24 each supporting a respective pair of camshafts 28 (not shown, but generally known in the art). Further, while the engine 20 is configured for use with automotive vehicles, those having ordinary skill in the art will appreciate that the present invention could be used in any suitable type of engine 20. By way of non-limiting example, the present invention could be used in connection with passenger or commercial vehicles, motorcycles, all-terrain vehicles, lawn care equipment, heavy-duty trucks, trains, airplanes, ships, construction vehicles and equipment, military vehicles, or any other suitable application without departing from the scope of the present invention.

As noted above, the present invention is directed toward a finger follower assembly 54 for use in the engine 20 valvetrain 36. More specifically, the finger follower assembly 54 cooperates with the valve 38, the lobe 50 of the camshaft 28, and the lash adjuster 52. As will be appreciated from the subsequent description below, the finger follower assembly 54 can be configured in a number of different ways without departing from the scope of the present invention. Moreover, while the finger follower assembly 54 described herein and illustrated throughout the drawings is configured for use with engine 20 valvetrains 36, the present invention could be used in connection with a number of different types of systems which employ cam-actuated valves.

Figure 3:
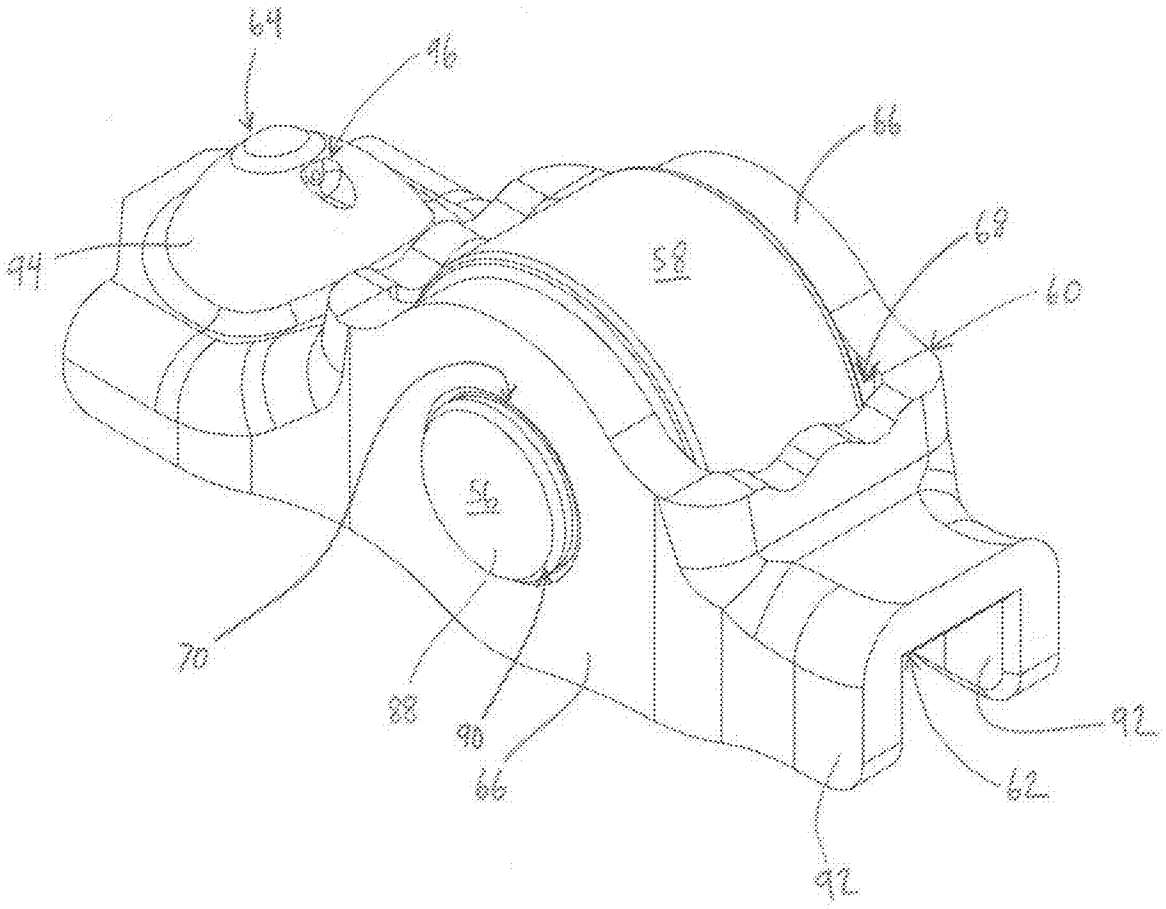
FIG. 3 is a top, rear-side perspective view of the finger follower assembly of FIG. 2.
Figure 4:
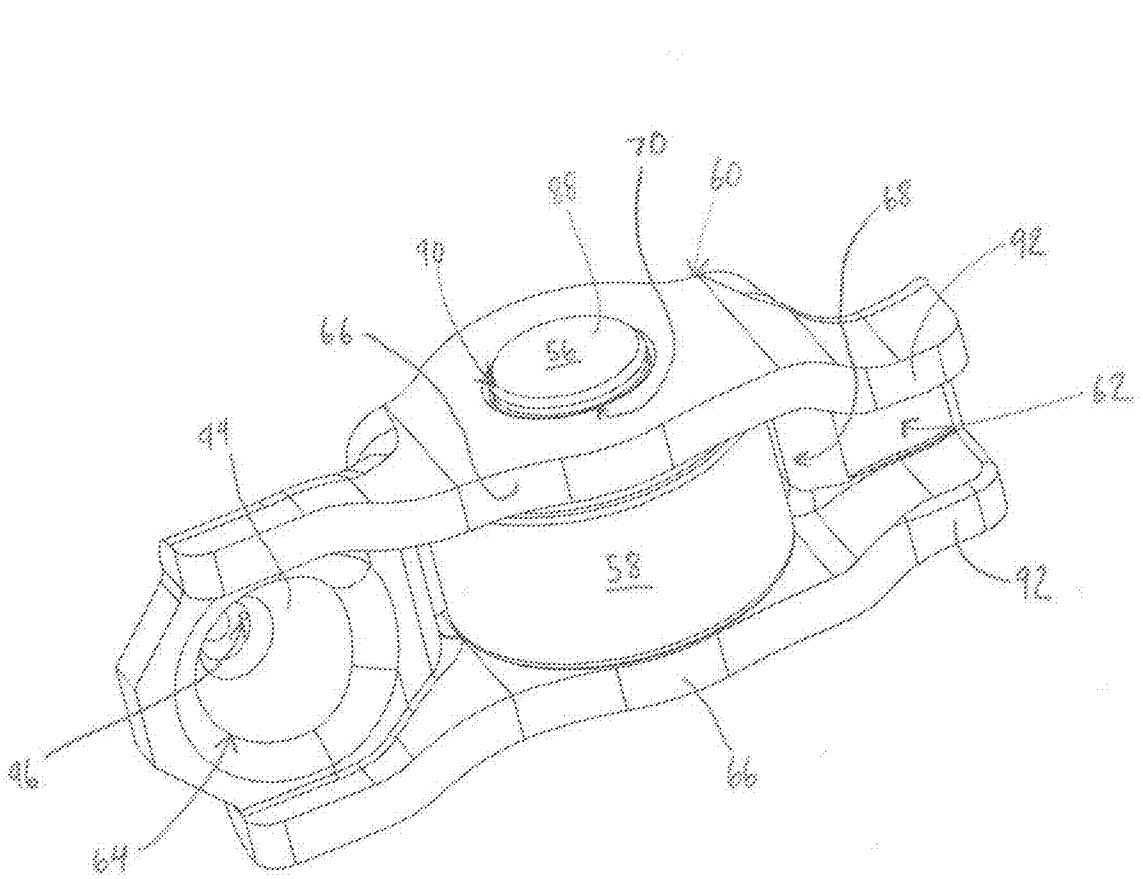
FIG. 4 is a bottom, front-side perspective view of the finger follower assembly of FIGS. 2-3.
Figure 5:
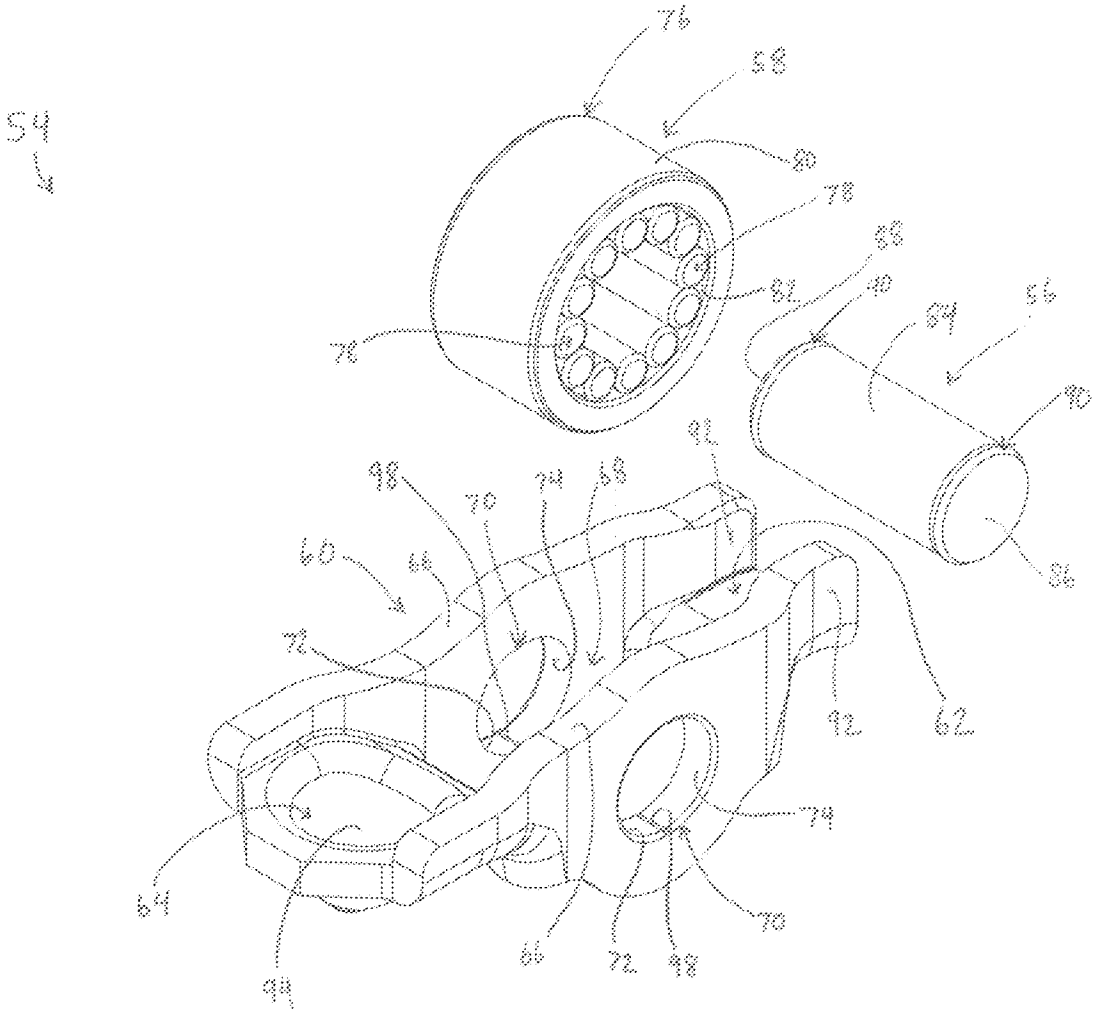
FIG. 5 is an exploded perspective view of the finger follower assembly of FIGS. 2-4, shown having: a shaft; a bearing; and a body provided with a socket, a pad, and a pair of walls each having a slot defined therein.

Referring now to FIGS. 3-5, one embodiment of the finger follower assembly 54 of the present invention is shown in detail. The finger follower assembly 54 includes a shaft 56, a bearing 58, and a body, generally indicated at 60. The bearing 58 is rotatably supported by the shaft 56 and is adapted to engage the lobe 50 of the camshaft 28. More specifically, the bearing 58 follows the profile of the lobe 50 such that when the camshaft 28 rotates, force is translated to the bearing 58 which simultaneously rotates the bearing 58 about the shaft 56 and urges the bearing 58 away from the camshaft 28 toward the valve 38 and the lash adjuster 52. Here, force that urges the bearing 58 away from the camshaft 28 is translated to the body 60 via the shaft 56, whereby the body 60 subsequently translates force to the lash adjuster 52 and the valve stem 42 to open the valve 38 so as to control the flow of gasses into (or, out of) the cylinder 30, as discussed above. To that end, the body 60 includes a pad 62 for engaging the valve 38, and a socket 64 spaced longitudinally from the pad 62 for engaging the lash adjuster 52. The pad 62 and the socket 64 are adapted to press against and remain substantially engaged to the valve 38 and the lash adjuster 52, respectively, as the camshaft 28 rotates in operation (see also FIG. 2).

As noted above, the finger follower assembly 54 of the present invention is described herein and illustrated throughout the drawings as forming part of an overhead-cam style valvetrain 36 of an engine 20. However, as will be appreciated from the subsequent description below, the advantages afforded by the finger follower assembly 54 of the present invention can be readily implemented so as to benefit any suitable valvetrain 36 in which the camshaft 28 lobe 50 engages the bearing 58 of the finger follower assembly 54 to translate rotation of the lobe 50 into movement of the valve 38. By way of non-limiting example, while the valvetrain 36 described herein is configured such that the finger follower assembly 54 engages a hydraulic lash adjuster 52 via the socket 64, the "lash adjuster" could be realized by a rigid component or structural feature (for example, a "solid lifter"). Moreover, the advantages of the finger follower assembly 54 of the present invention could also be implemented into a cam-roller-follower used in connection with a "cam-in-block" engine valvetrain with a pushrod and tappet interposed between the rocker arm and the camshaft (not shown, but generally known in the related art). Thus, it will be appreciated that terms-of-the-art such as "lash adjuster," "finger follower," and the like as used herein are intended to be non-limiting. Put differently, the present invention affords significant opportunities for use in a number of different systems where an intermediate member (for example, a rocker arm or finger follower) employs rollers or bearings to effect translation of camshaft lobe rotation into valve movement.

As is shown best in FIG. 5, the body 60 includes a pair of walls 66 spaced laterally from each other and disposed between the pad 62 and the socket 64. The walls 66 define a valley therebetween, generally indicated at 68, for accommodating the bearing 58 and a portion of the shaft 56. The body 60 also includes a slot, generally indicated at 70, formed in each of the walls 66. Here, the slots 70 cooperate to support the shaft 56 with respect to the body 60. To this end, each of the slots 70 has a respective pair of eccentric arc-shaped bearing surfaces 72, 74. Put differently, each of the slots 70 has a first arc-shaped bearing surface 72, and a second arc-shaped bearing surface 74 which is non-concentric with the first arc-shaped bearing surface 72. The eccentric arc-shaped bearing surfaces 72, 74 are arranged to allow the shaft 56 to rotate within the slots 70 and also to move along the slots 70 so as to facilitate alignment of the bearing 58 with respect to engagement with the lobe 50 of the camshaft 28 independent of alignment of the pad 62 of the body 60 with respect to engagement with the valve 38 and of alignment of the socket 64 of the body 60 with respect to engagement with the lash adjuster 52. The shaft 56, the bearing 58, the body 60, and the slots 70 of the finger follower assembly 54 will each be described in greater detail below.

Referring now to FIGS. 2-10, as noted above, the bearing 58 of the finger follower assembly 54 is supported for rotation about the shaft 56 and is adapted to rotatably engage the lobe 50 of the camshaft 28. As illustrated in FIG. 2, the camshaft 28 rotates about a camshaft axis CA and the bearing 58 of the finger follower assembly 54 rotates about a bearing axis BA. As is described in greater detail below in connection with FIGS. 6A-6C, the camshaft axis CA and the bearing axis BA are advantageously parallel during operation of the engine 20 so as to ensure proper engagement between the bearing 58 of the finger follower assembly 54 and the lobe 50 of the camshaft 28.

In the representative embodiment illustrated herein, and as is best shown in FIG. 5, the bearing 58 includes a bearing race 76 and a plurality of needle bearing elements 78. Here, the needle bearing elements 78 are interposed between the shaft 56 and the bearing race 76 in a conventional needle bearing arrangement. The bearing race 76 has an annular configuration with an outer race surface 80 and an inner race surface 82 concentrically aligned with the outer race surface 80. The shaft 56, in turn, has a cylindrical configuration with an outer shaft surface 84 extending laterally between a first shaft end 86 and a second shaft end 88. The needle bearing elements 78 likewise each have a cylindrical configuration and are arranged in engagement with both the outer shaft surface 84 of the shaft 56 and the inner race surface 82 of the bearing race 76 such that the shaft 56 is concentrically aligned with the bearing race 76. Thus, the shaft 56 is aligned with the bearing axis BA defined by rotation of the bearing 58 in operation. While the bearing 58 described herein and illustrated throughout the drawings employs needle bearing elements 78 and the bearing race 76, those having ordinary skill in the art will appreciate that the bearing 58 could be configured in any suitable way sufficient to rotate about and concentrically with the shaft 56 without departing from the scope of the present invention. By way of non-limiting example, the bearing could be realized as a journal bearing rotatably supported on the shaft (not shown, but known in the related art).

As noted above and as is described in detail below, the shaft 56 is supported for rotation within and movement along the slots 70 of the body 60. In the representative embodiment illustrated herein, the slots 70 are formed as apertures defined in and extending through each of the walls 66 of the body 60 (see FIG. 10). Here, in order to retain the shaft 56 with respect to the body 60 while, at the same time, allowing rotation within and movement along the slots 70, the shaft 56 is provided with a retainer 90 disposed at each of the shaft ends 86, 88 arranged to restrict lateral movement of the shaft 56 along the slots 70 of the body 60. Thus, the retainers 90 prevent the shaft 56 from moving laterally out of the slots 70 in operation. In the representative embodiment illustrated herein, the shaft 56 is configured to extend through the slots 70 such that the shaft ends 86, 88 protrude laterally beyond the respective walls 66 of the body 60. The retainers 90 are formed integrally with the shaft 56 at each of the shaft ends 86, 88, such as by mechanical deformation or "mushrooming" which laterally restricts movement of the shaft 56 without preventing rotation of the shaft 56 within the slots 70 and without preventing translation of the shaft 56 along the slots 70 in operation.

Those having ordinary skill in the art will appreciate that the shaft 56 and/or the retainers 90 could be formed, configured, or realized in any suitable way sufficient to restrict lateral movement without preventing rotation and translation, as noted above, without departing from the scope of the present invention. By way of non-limiting example, it is conceivable that the retainers could be realized as circlips, snap-rings, or other suitable types of fasteners arranged adjacent to the shaft ends 86, 88 of the shaft 56 (not shown, but generally known in the related art). Similarly, it is conceivable that the retainers 90 could be implemented to allow the shaft 56 to be shaped so the shaft ends 86, 88 do not necessarily protrude beyond the walls 66 of the body 60, such as with retainers 90 formed along or otherwise operatively attached to the shaft 56 on opposing lateral sides of the bearing 56, such as within the valley 68 adjacent to the walls 66 (not shown). Furthermore, while the representative embodiment of the finger follower assembly 54 illustrated herein employs slots 70 formed through the walls 66 of the body 60, it will be appreciated that the slots 70 could be formed, configured, or otherwise arranged in a number of different ways sufficient to support the shaft 56 for rotation and translation, as noted above, without departing from the scope of the present invention.

In the representative embodiment illustrated throughout the drawings, the body 60 of the finger follower assembly 54 is formed as a unitary, one-piece component. More specifically, the body 60 is manufactured from a single piece of sheet steel that is stamped, bent, formed, and the like to define and arrange the walls 66, the pad 62, the socket 64, the slots 70, and the valley 68. However, those having ordinary skill in the art will appreciate that the body 60 can be formed in a number of different ways, and from any suitable number of components, so as to facilitate the rotation and translation of the shaft 56 noted above, without departing from the scope of the present invention. In one embodiment, the body 60 also includes a pair of pad braces 92 arranged adjacent to and spaced on opposing lateral sides of the pad 62. Here, the pad braces 92 help align the finger follower assembly 54 to the valve 38, such as during installation of the finger follower assembly 54 into the cylinder head 24. Similarly, the socket 64 has a curved pocket 94 for accommodating and aligning with a portion of the lash adjuster 52 (not shown in detail, but generally known in the art). However, those having ordinary skill in the art will appreciate that the pad 62 and/or the socket 64 could be configured in any suitable way without departing from the scope of the present invention. Here too in this embodiment, the body 60 is provided with a lubrication arrangement, generally indicated at 96, formed adjacent to the curved pocket 94 of the socket 64 and arranged to direct lubricating fluid supplied to the lash adjuster 52 towards the shaft 56, the bearing 58, the pad 62, and/or other parts of the valvetrain 36. However, those having ordinary skill in the art will appreciate that the body 60 could be configured in a number of different ways without departing from the scope of the present invention.

Figures 6A, 6B, 6C:
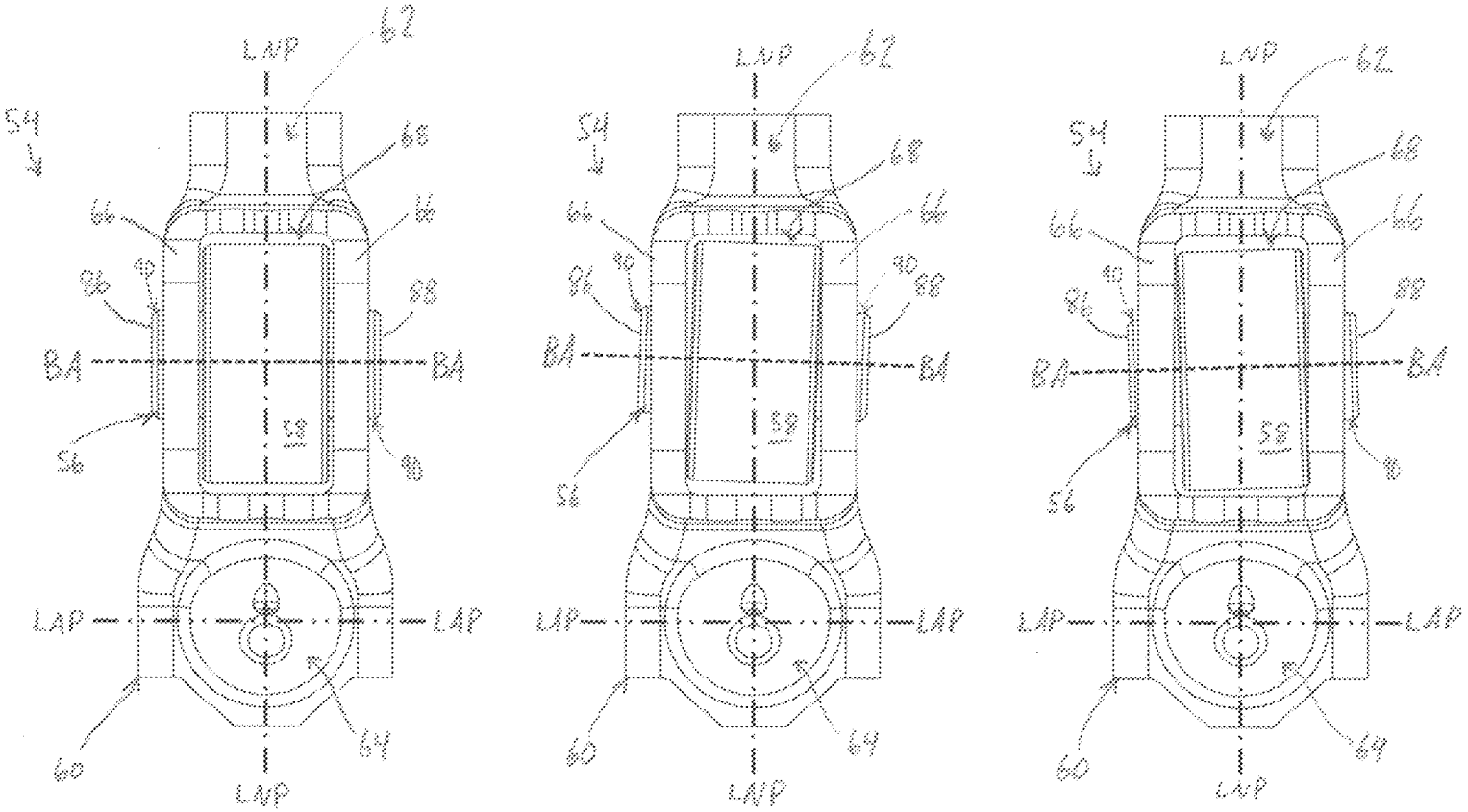
FIG. 6A is a top-side view of the finger follower assembly of FIGS. 2-5, shown with a rotational axis of the bearing aligned parallel with a lateral reference plane defined adjacent to the socket and aligned perpendicularly to a longitudinal reference plane defined between said socket and the pad.
FIG. 6B is another top-side view of the finger follower assembly of FIGS. 2-6A, shown with the rotational axis of the bearing skewed clockwise with respect to the lateral reference plane.
FIG. 6C is another top-side view of the finger follower assembly of FIGS. 2-6B, shown with the rotational axis of the bearing skewed counterclockwise with respect to the lateral reference plane.
Figure 7:
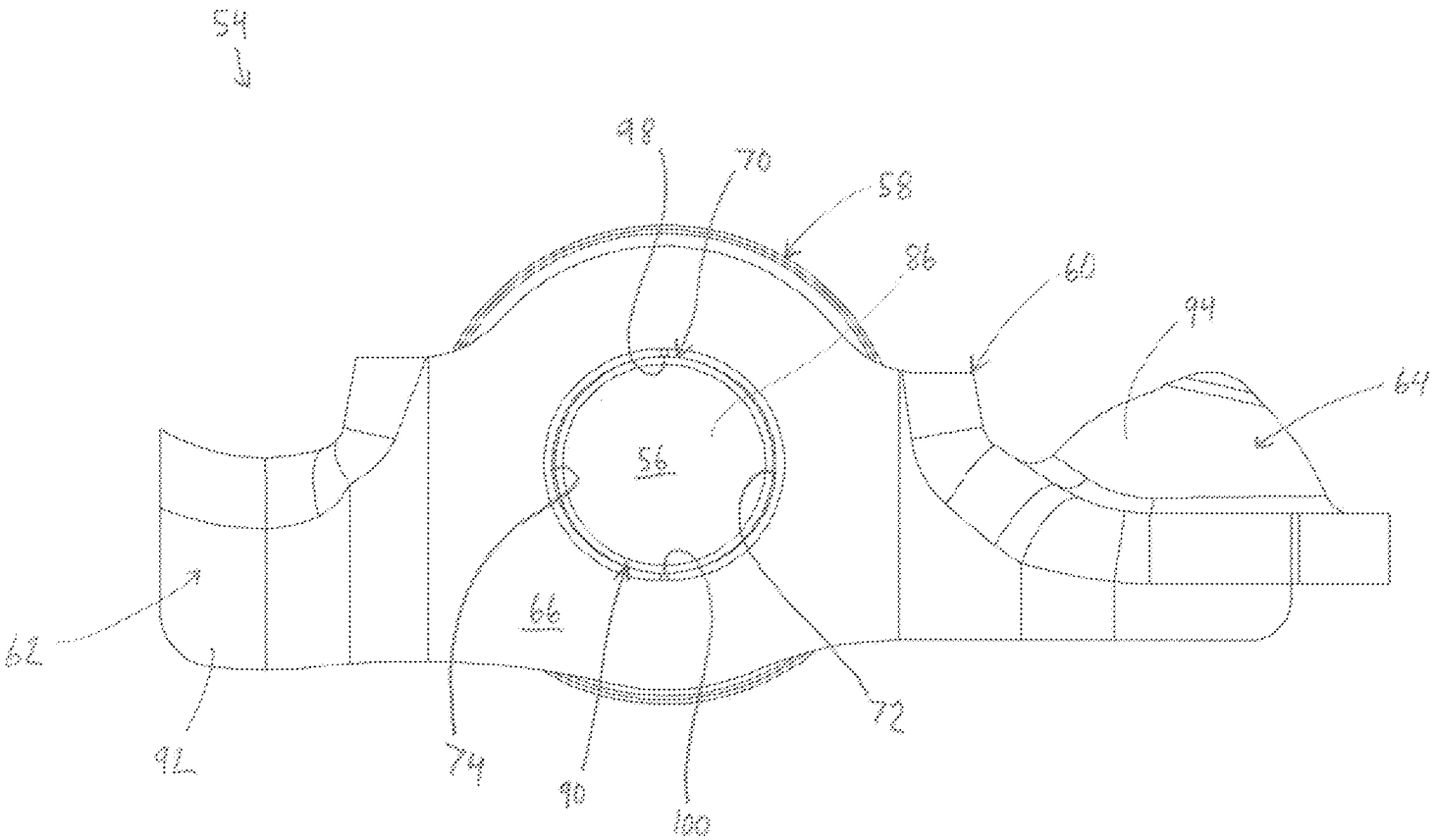
FIG. 7 is a right-side view of the finger follower assembly of FIGS. 2-6C.
Figure 8:
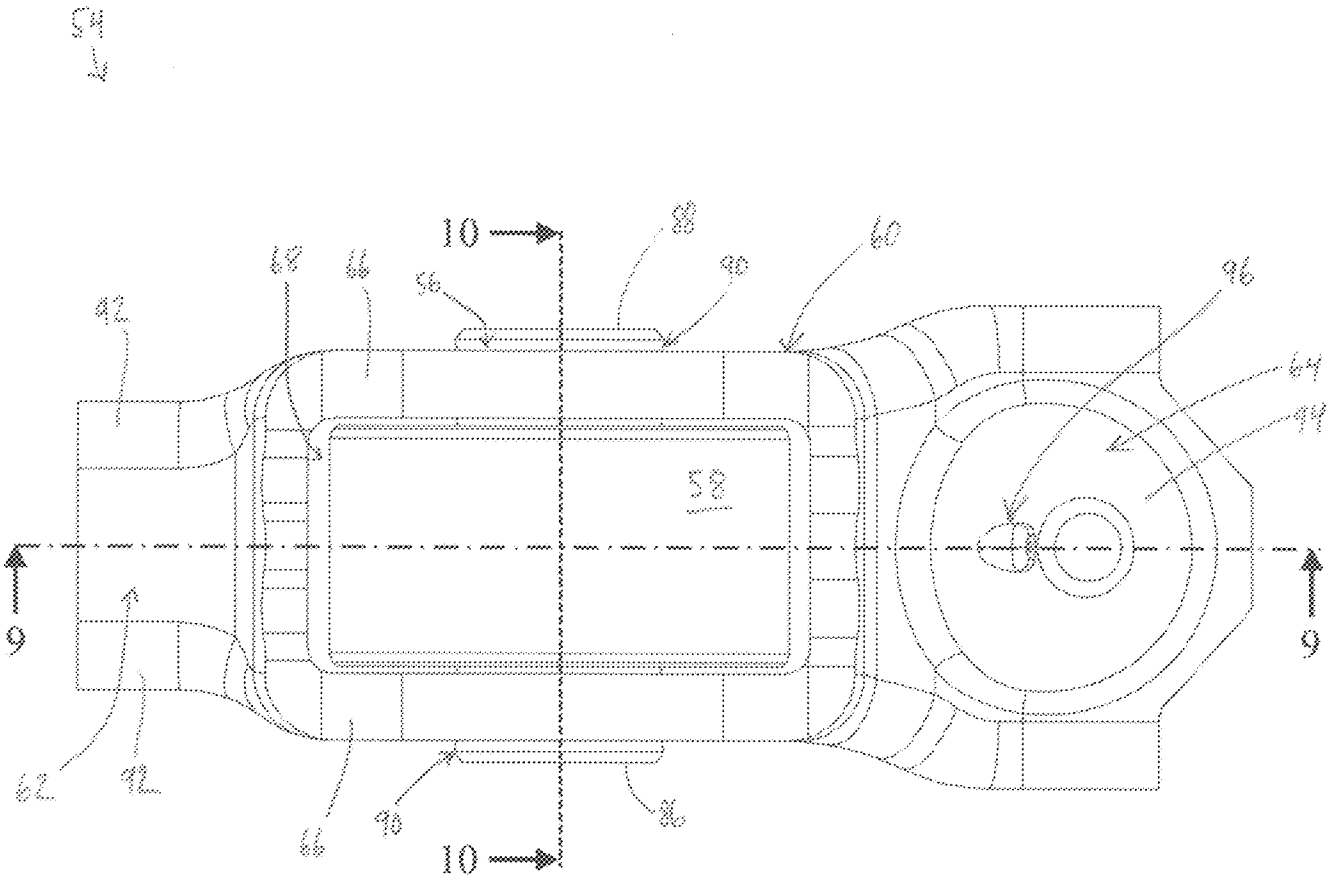
FIG. 8 is another top-side view of the finger follower assembly of FIGS. 2-7.
Figure 9:
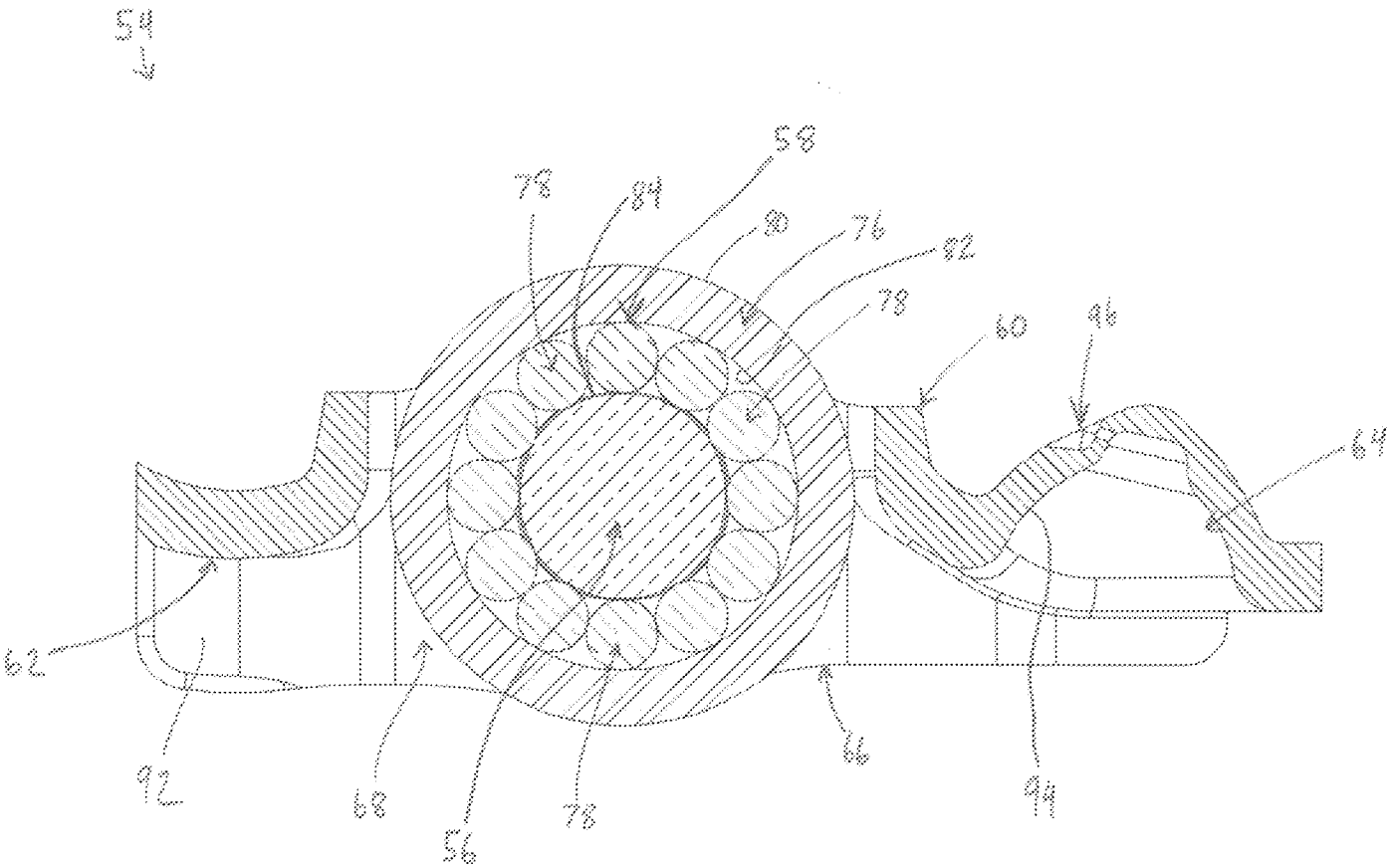
FIG. 9 is a sectional view taken along line 9-9 in FIG. 8.
Figure 10:
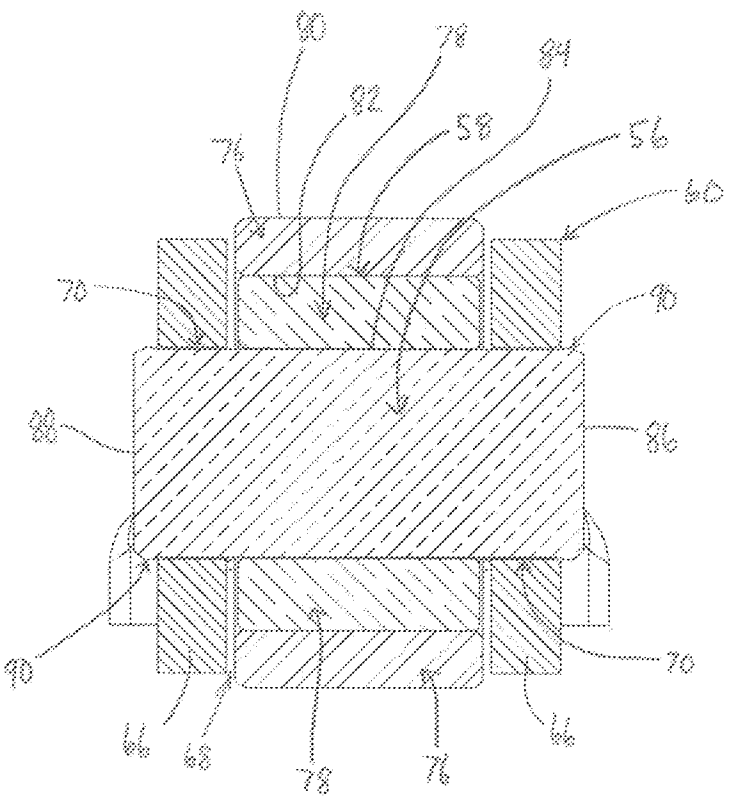
FIG. 10 is a sectional view taken along line 10-10 in FIG. 8.
Figure 11:
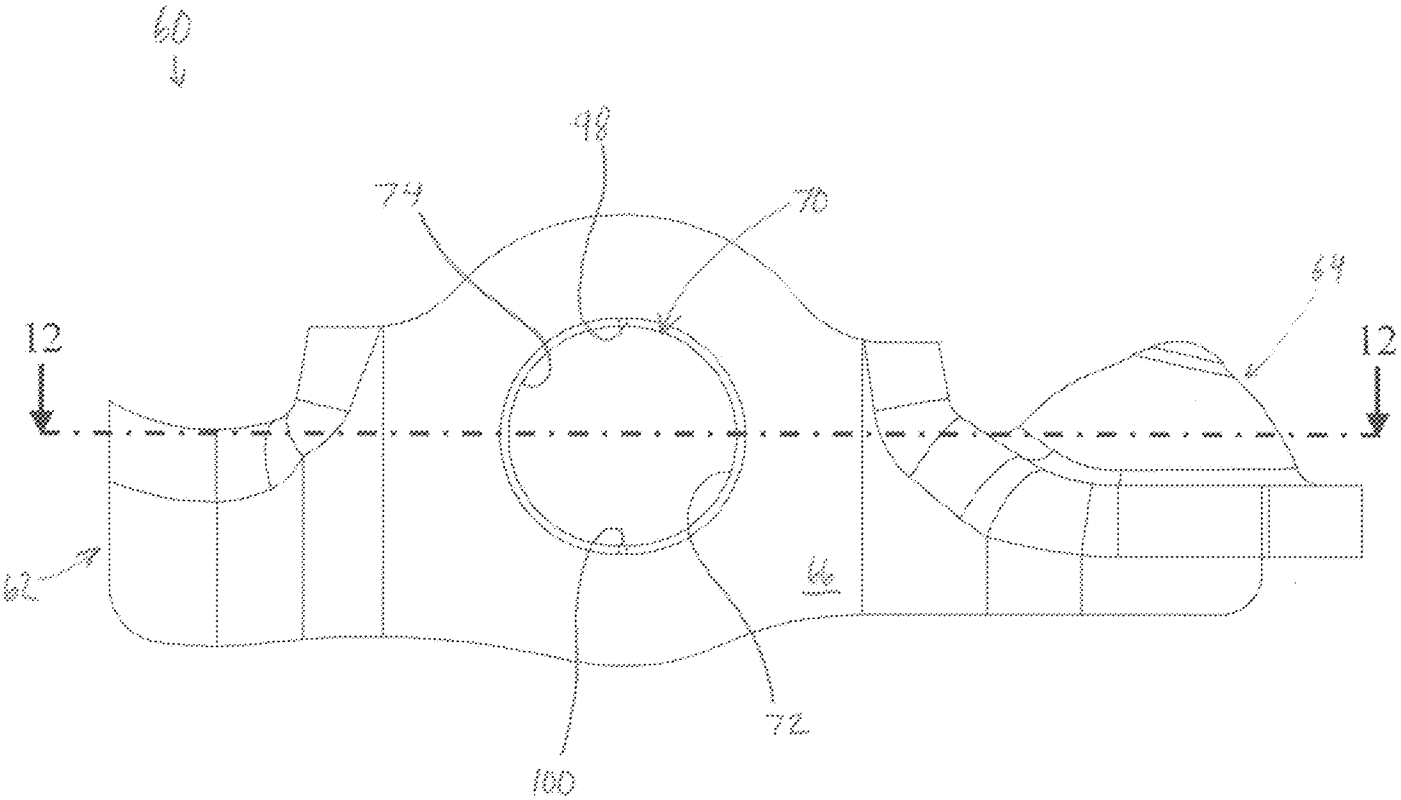
FIG. 11 is a right-side view of the body of the finger follower assembly of FIGS. 2-10.
Figure 12:
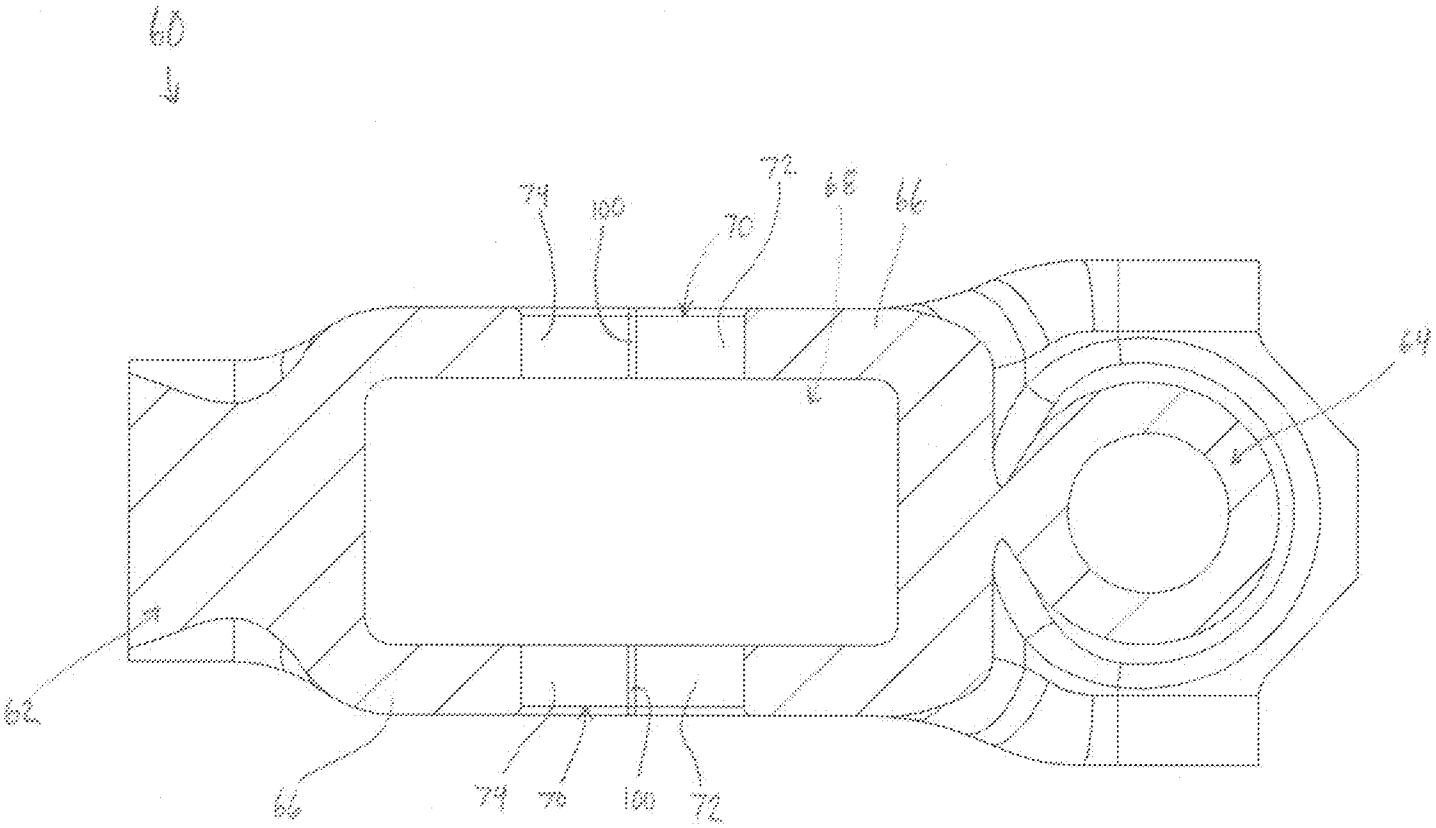
FIG. 12 is a sectional view taken along line 12-12 in FIG. 11.

Referring now to FIGS. 6A-6C in particular, the body 60 of the finger follower assembly 54 has a profile which is substantially laterally symmetric. For illustrative purposes, FIGS. 6A-6C are depicted with a longitudinal reference plane LNP (depicted as a dash-dot-dash line) and a lateral reference plane LAP (depicted as a dash-dot-dot-line) which are aligned to the body 60. Specifically, the longitudinal reference plane LNP is defined longitudinally between the socket 64 and the pad 62 and is arranged laterally between the walls 66 (and, thus, laterally between the slots 70), and the lateral reference plane LAP is defined adjacent to the socket 64 and is aligned perpendicularly to the longitudinal reference plane LNP. Those having ordinary skill in the art will appreciate that the two-dimensional planes described herein with respect to the longitudinal reference plane LNP and the lateral reference plane LAP are illustrated as one-dimensional lines in FIGS. 6A-6CF for the non-limiting purposes of clarity and consistency. While not depicted herein, the two-dimensional planes described above could conceivably be defined as perpendicularly-arranged one-dimensional reference axes.

In FIG. 6A, the dash-dash line representing the bearing axis BA of the bearing 58 is parallel to the dash-dot-dot-dash line representing the lateral reference plane LAP of the body 60. In FIG. 6B, the dash-dash line representing the bearing axis BA of the bearing 58 is skewed clockwise with respect to the dash-dot-dot-dash line representing the lateral reference plane LAP of the body 60. Put differently, in FIG. 6B, the shaft 56 and the bearing 58 are non-parallel to the dash-dot-dot-dash line representing the lateral reference plane LAP of the body 60 such that the first shaft end 86 is generally arranged closer to the pad 62 than to the socket 64 when compared to the second shaft end 88, which is generally arranged closer to the socket 64 than to the pad 62. Conversely, in FIG. 6C, the dash-dash line representing the bearing axis BA of the bearing 58 is skewed counter-clockwise with respect to the dash-dot-dot-dash line representing the lateral reference plane LAP of the body 60. Put differently, in FIG. 6C, the shaft 56 and the bearing 58 are non-parallel to the dash-dot-dot-dash line representing the lateral reference plane LAP of the body 60 such that the first shaft end 86 is generally arranged closer to the socket 64 than to the pad 62 when compared to the second shaft end 88, which is generally arranged closer to the pad 62 than to the socket 64. The skewing of the shaft 56 and the bearing 58 illustrated in FIGS. 6A-6C will be described in greater detail below.

Because the cylinder head 24 necessarily defines the specific arrangement, orientation, and alignment of and between the lobe 50 of the camshaft 28, the valve 38, and the lash adjuster 52, it will be appreciated that misalignment of any one of the components of the valvetrain 36 can cause increased friction and heat generation which may result in disadvantageous component wear, excessive noise, decreased component life, and the like. Such misalignment can be exacerbated by the realties of manufacturing, including design parameters and tolerances, tolerance stack up, component-to-component manufacturing variation, as well as the use of different manufacturing locations, machines, tooling, suppliers, vendors, material sources, and the like. By way of illustrative example, it is conceivable that the cylinder head 24 could be manufactured in such a way that the camshaft 28 could rotate about a misaligned axis with respect to an intended rotational axis defined based on the arrangement of the valve 38 and the lash adjuster 52. In this situation, conventional finger followers would necessarily tend to align with the lobe 50 of the camshaft 28, which causes reactive axial forces to act on the camshaft 28 and which also causes misalignment between the valve 38 and pad and/or the lash adjuster 52 and socket. In another illustrative example, in a conventional finger follower assembly, such as where the shaft is fixed to the body, it may be prohibitively cumbersome and/or expensive to properly align the shaft and the body to ensure proper alignment of the bearing with respect to the body.

Either of the illustrative examples set forth above could result in increased friction and heat generation leading to excessive wear of the various components of the valvetrain 36, which may result in unacceptable engine 20 noise and decreased component life. On the other hand, the finger follower assembly 54 of the present invention affords substantially improved performance in situations like those described above resulting from misalignment of one or more valvetrain 36 components in use. Specifically, as noted above, the eccentric arc-shaped bearing surfaces 72, 74 of the slots 70 formed in the body 60 of the finger follower assembly 54 of the present invention are arranged to allow the shaft 56 to rotate within the slots 70 and also to move along the slots 70 so as to facilitate alignment of the bearing 58 with respect to engagement with the lobe 50 of the camshaft 28 independent of alignment of the pad 62 of the body 60 with respect to engagement with the valve 38 and of alignment of the socket 64 of the body 60 with respect to engagement with the lash adjuster 52. Thus, the finger follower assembly 54 of the present invention affords significantly improved wear resistance, component life, and reduction to friction, heat generation, and noise while, at the same time, allowing the finger follower assembly 54 to be manufactured in a simple, cost-effective manner.

Figure 13:
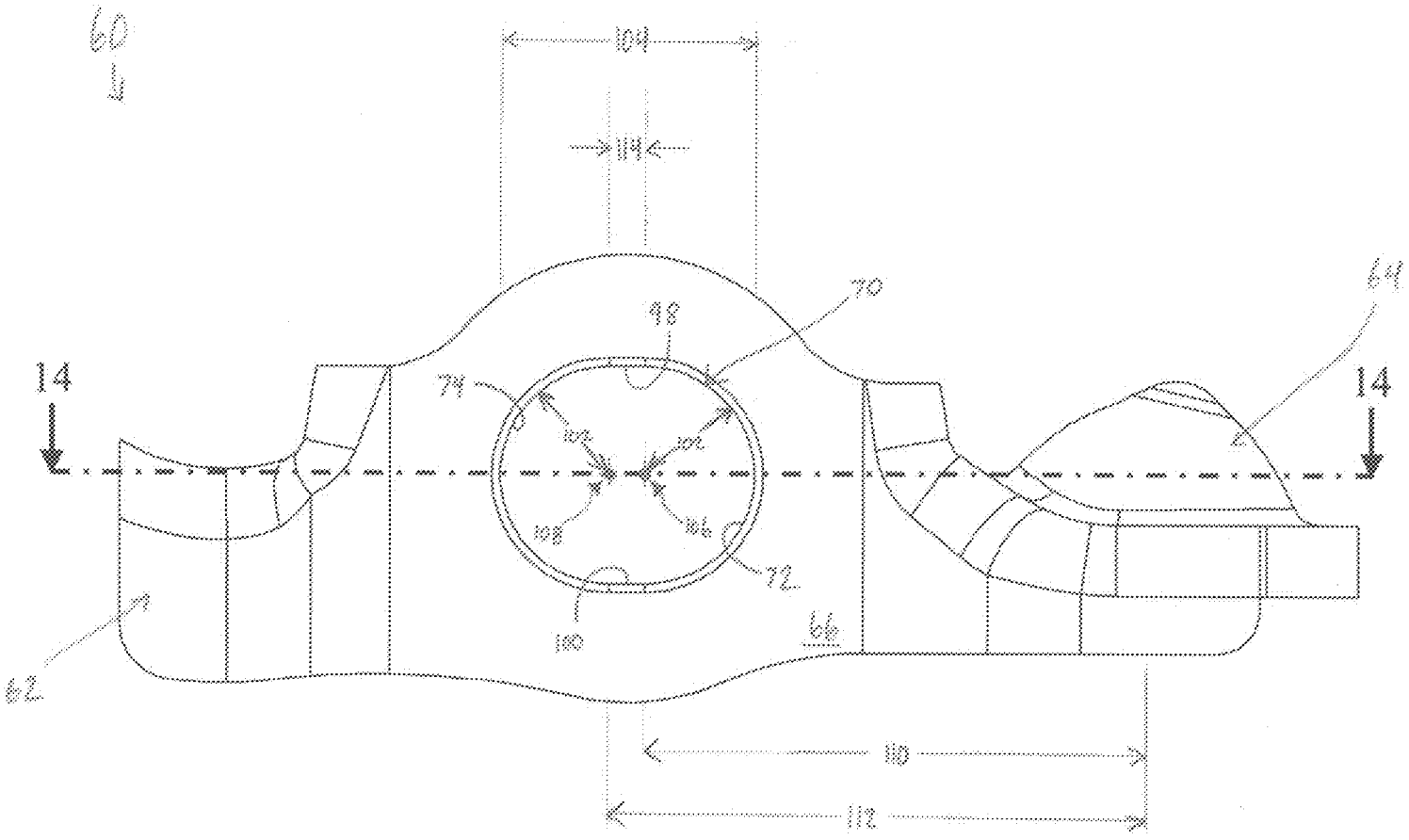
FIG. 13 is a right side view of a body of a finger follower assembly according to one embodiment of the present invention, shown having exaggerated slots formed in the body for illustrative purposes.
Figure 14:
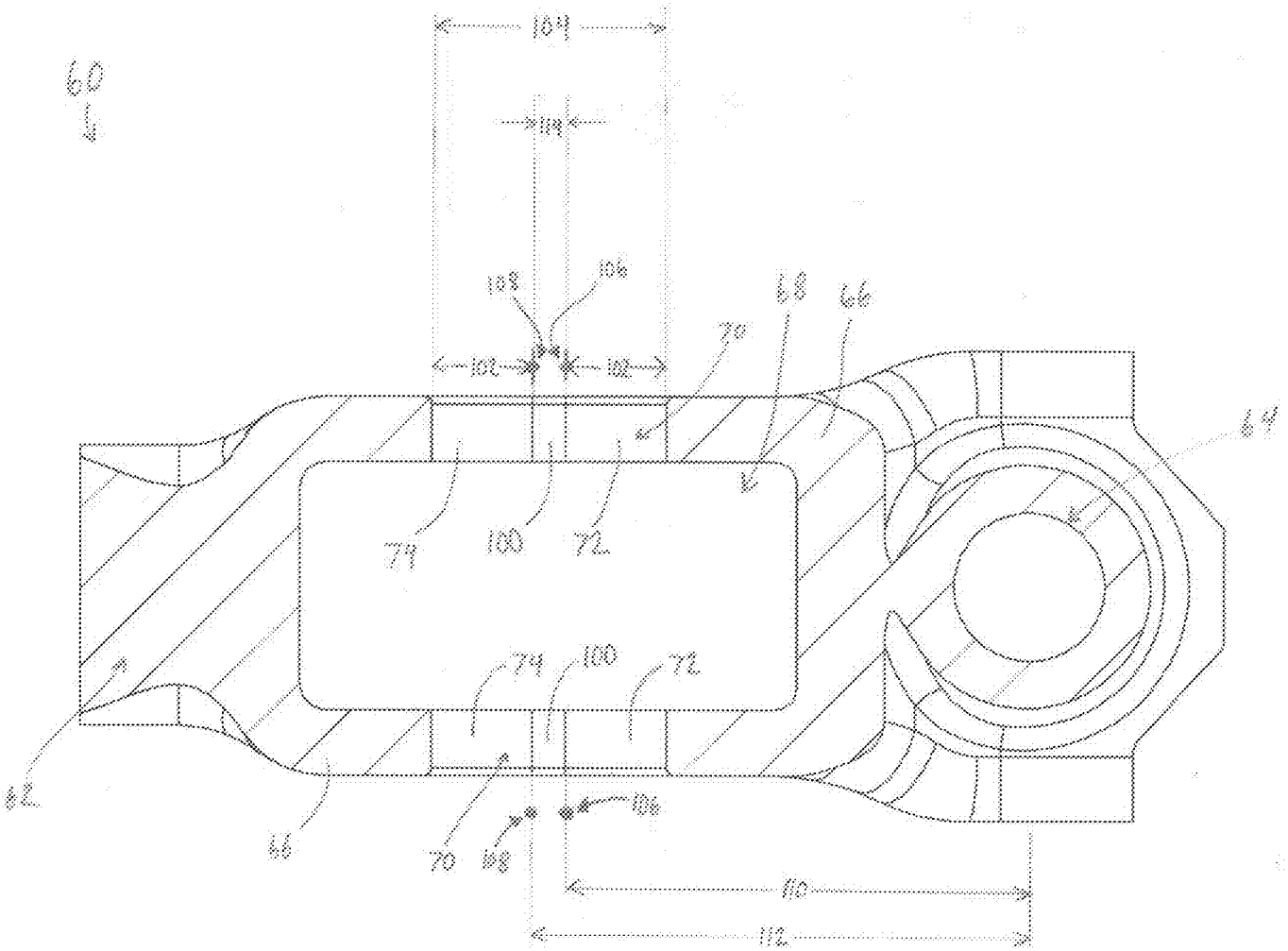
FIG. 14 is a section view taken along line 14-14 in FIG. 13, showing additional detail of the exaggerated slots for illustrative purposes.

Referring now to FIGS. 11-14, the body 60 of the finger follower assembly 54 is shown. Specifically, the body 60 shown in FIGS. 11-12 corresponds to the body 60 depicted in FIGS. 2-11, and the body 60 shown in FIGS. 13-14 is provided with exaggerated slots 70 for the purposes of clarity and consistency. Thus, in the description that follows, the same terms and reference numerals will be used to describe the slots 70 depicted in FIGS. 11-14.

As noted above, the first arc-shaped bearing surface 72 and the second arc-shaped bearing surface 74 of the slots 70 are eccentric. Here, in one embodiment, each of the slots 70 further include a pair of transition bearing surfaces 98, 100 arranged longitudinally between and merging with the pair of arc-shaped bearing surfaces 72, 74. Put differently, each slot 70 has a first transition bearing surface 98 and a second transition bearing surface 100. Here, the transition bearing surfaces 98, 100 are generally parallel to each other. However, as will be appreciated from the subsequent description below, the slots 70 could have any suitable shape, profile, or configuration sufficient to include two eccentric arc-shaped bearing surfaces 72, 74 without departing from the scope of the present invention.

In the representative embodiment of the finger follower assembly 54 illustrated herein, each of the arc-shaped bearing surfaces 72, 74 has a constant radius of curvature 102, and the radius of curvature 102 of each arc-shaped bearing surface 72, 74 is the same (see FIGS. 13-14). However, those having ordinary skill in the art will appreciate that that the slots 70 could include arc-shaped bearing surfaces 72, 74 having differently configured curvatures, constant or otherwise, equivalent to each other or not, without departing from the scope of the present invention. Furthermore, while both slots 70 formed in the body 60 are identical to each other and are aligned with each other, it will be appreciated that the slots 70 could each have different profiles, shapes, and/or arrangements and could be aligned in any suitable way sufficient to allow the shaft 56 to rotate and translate along the slots 70 as noted above, without departing from the scope of the present invention. In one embodiment, the slots 70 each have a slot width 104 defined longitudinally between the arc-shaped bearing surfaces 72, 74 (see FIGS. 13-14). Here, the slot width 104 is greater than four times the radius of curvature 102 of the arc-shaped bearing surfaces 72, 74.

As is depicted in FIGS. 13-14, in one embodiment, the first arc-shaped bearing surface 72 of each of the slots 70 has a first center of curvature 106, and the second arc-shaped bearing surface 74 of each of the slots 70 has a second center of curvature 108 which is spaced from the first center of curvature 106. In one embodiment, the first centers of curvature 106 are spaced from the socket 64 at a first center distance 110 and the second centers of curvature 108 are spaced from the socket 64 at a second center distance 112 greater than the first center distance 110. In one embodiment, the first centers of curvature 106 of the first arc-shaped bearing surfaces 72 are spaced from the second centers of curvature 108 of the second arc-shaped bearing surfaces 74 at a slot distance 114. Here, the slot distance 114 is less than the radius of curvature 102. In one embodiment, the slot distance 114 is between 10 and 500 microns. In one embodiment, the slot distance is between 50 and 300 microns.

Figure 15:
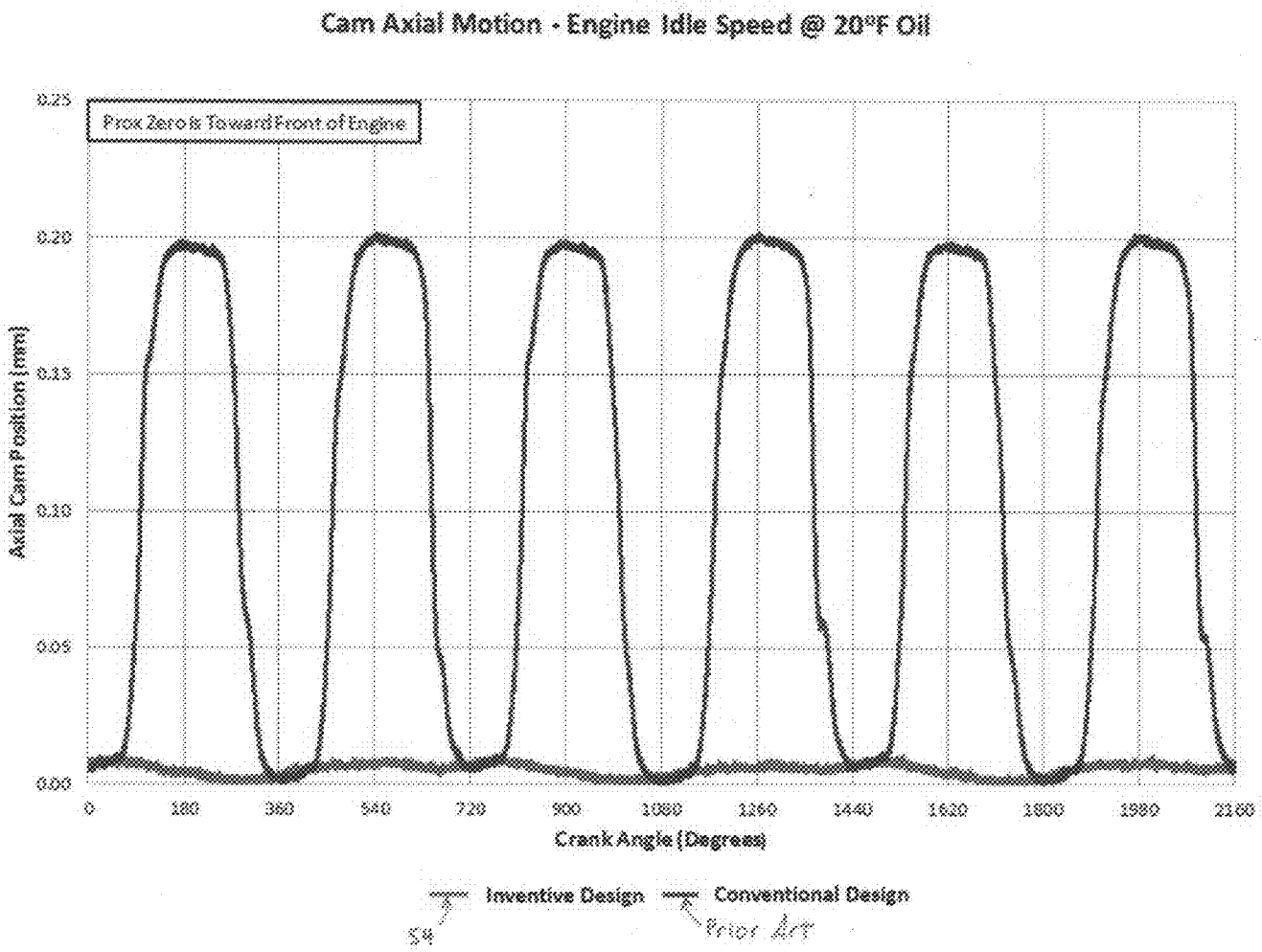
FIG. 15 is a chart of axial camshaft position with respect to crankshaft angle of an engine operating at idle speed and at 20° F. oil temperature, the chart depicting: graphed data collected using a finger follower assembly of the present invention, and graphed data collected using a conventional finger follower.
Figure 16:
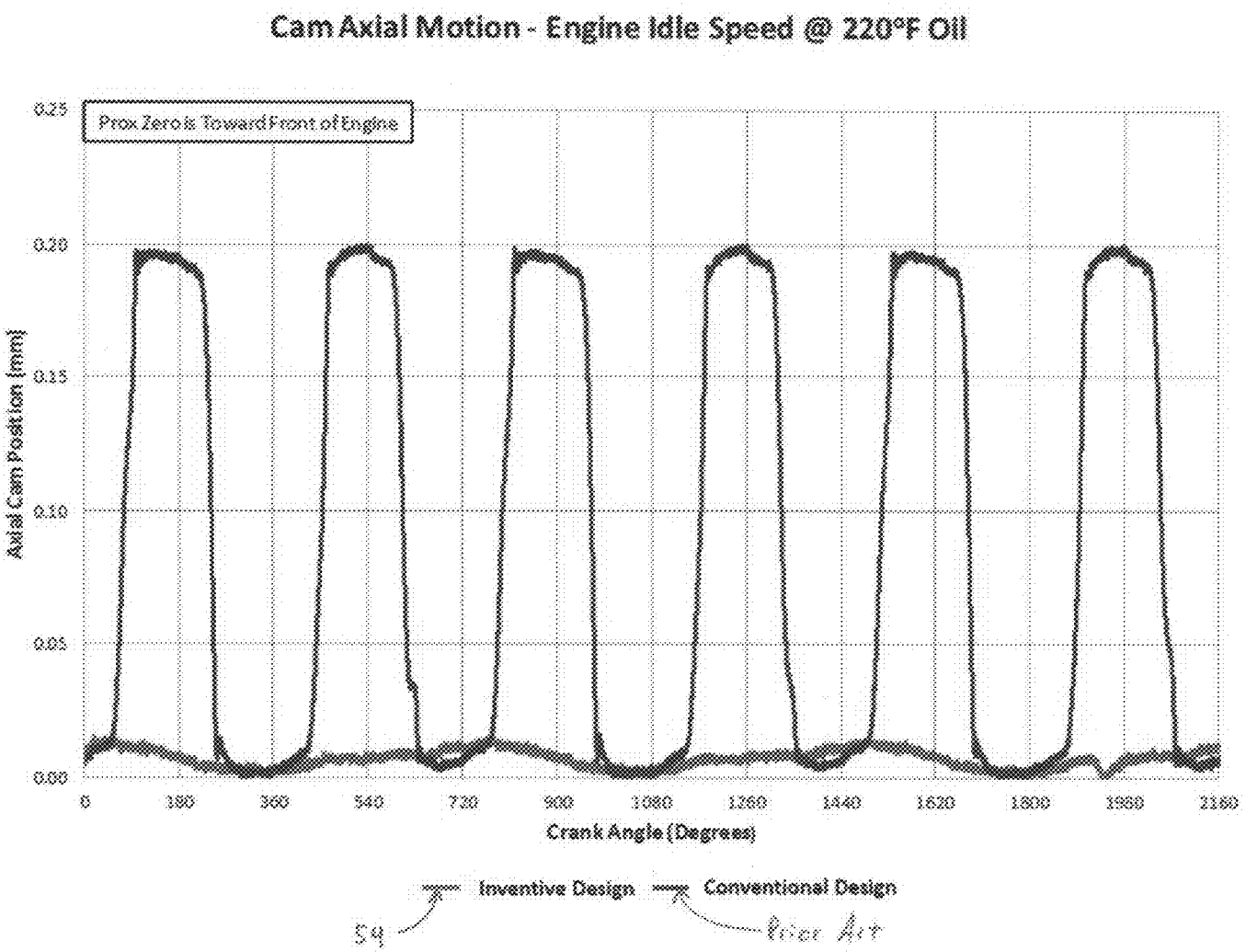
FIG. 16 is a chart of axial camshaft position with respect to crankshaft angle of an engine operating at idle speed and at 220° F. oil temperature, the chart depicting: graphed data collected using a finger follower assembly of the present invention, and graphed data collected using a conventional finger follower.
Figure 17:
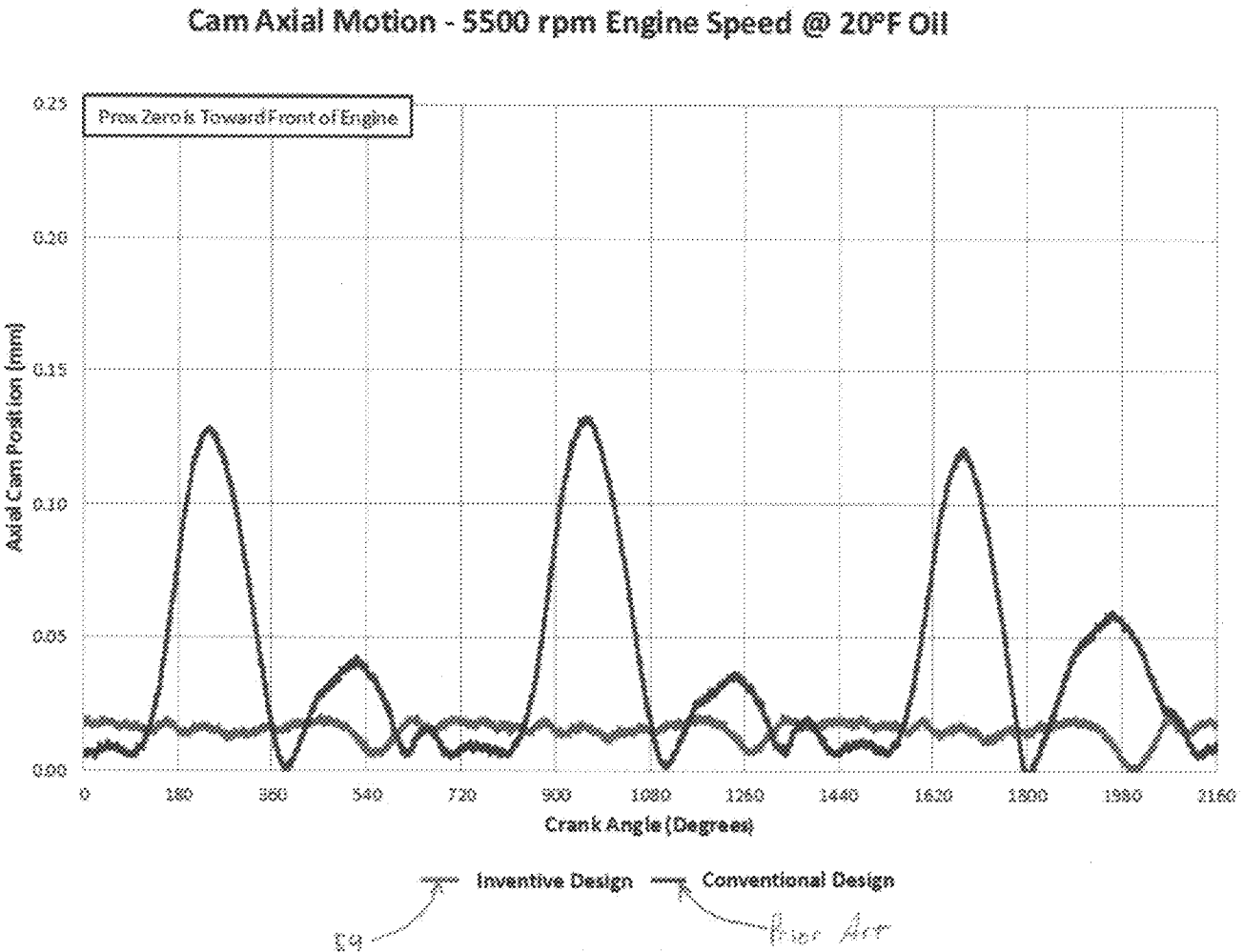
FIG. 17 is a chart of axial camshaft position with respect to crankshaft angle of an engine operating at 5500 RPM and at 20° F. oil temperature, the chart depicting: graphed data collected using a finger follower assembly of the present invention, and graphed data collected using a conventional finger follower.
Figure 18:
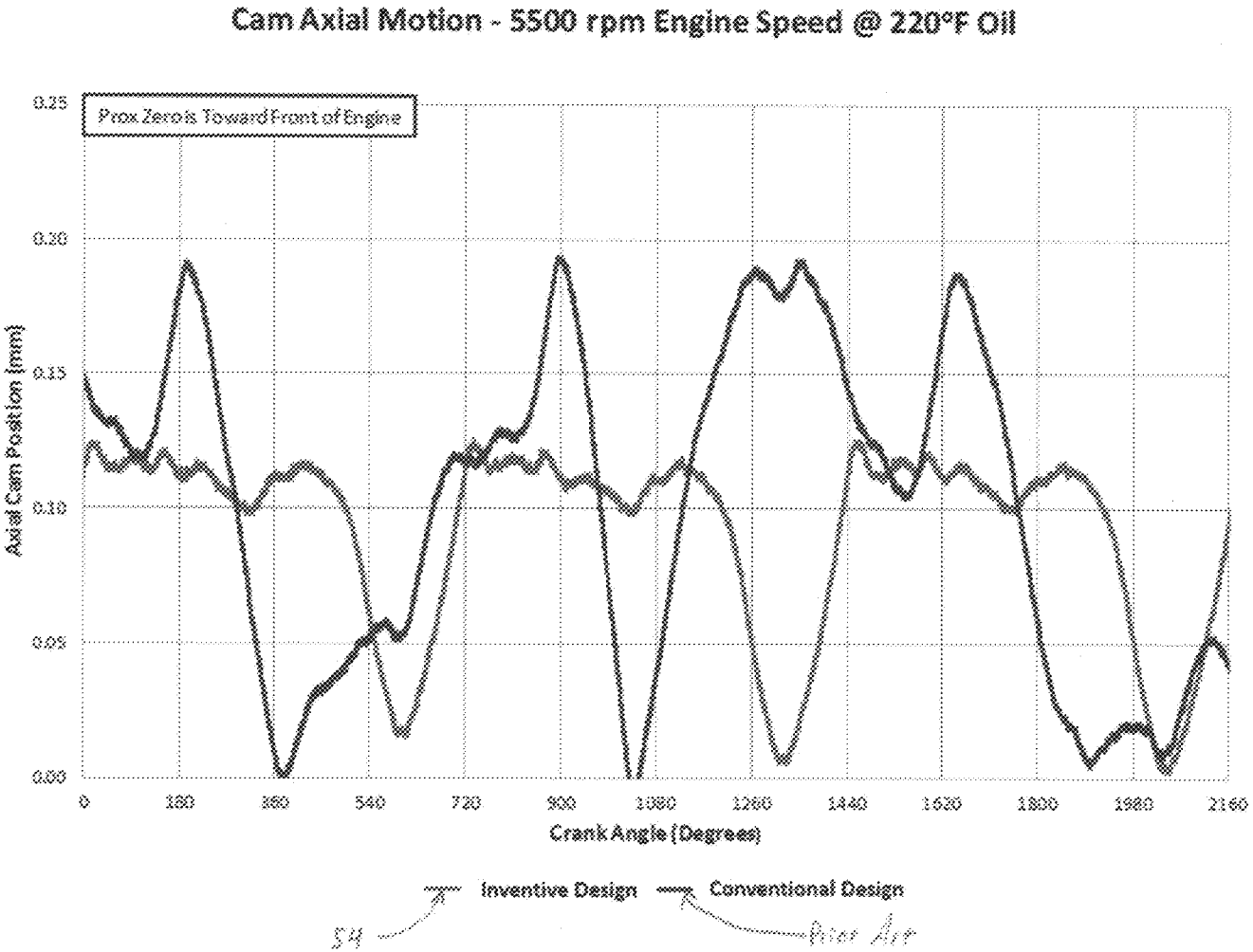
FIG. 18 is a chart of axial camshaft position with respect to crankshaft angle of an engine operating at 5500 RPM and at 220° F. oil temperature, the chart depicting: graphed data collected using a finger follower assembly of the present invention, and graphed data collected using a conventional finger follower.

Referring now to FIGS. 15-18, graphed data collected using a finger follower assembly 54 of the present invention, and graphed data collected using a conventional finger follower, are shown in charts depicting axial camshaft 28 position with respect to crankshaft 26 angle during engine 20 operation at: idle speed and at 20° F. oil temperature (FIG. 15); idle speed and at 220° F. oil temperature (FIG. 16); 5500 RPM and at 20° F. oil temperature (FIG. 17); and 5500 RPM and at 20° F. oil temperature. These data were collected on an engine 20 test stand using a proximity sensor to measure axial camshaft 28 position and a rotational sensor to measure crankshaft 26 angle. The data shown in each of the charts illustrated in FIGS. 15-18 show significant reduction in axial camshaft 28 movement during engine 20 operation in the data collected using the finger follower assembly 54 of the present invention compared to the data collected using a conventional finger follower assembly. In particular, as illustrated in FIGS. 15 and 16, the finger follower assembly 54 of the present invention reduces axial camshaft 28 movement by nearly a factor of ten when compared to the conventional finger follower assembly. Furthermore, as illustrated in FIGS. 17 and 18, the finger follower assembly 54 of the present invention also significantly reduces axial camshaft 28 movement with the engine 20 running at speed, and under a number of different operating temperatures.

In this way, the finger follower assembly 54 of the present invention significantly reduces the cost and complexity of manufacturing and assembling the valvetrain 36 and associated components. Specifically, it will be appreciated that the configuration of the slots 70 formed in the body 60 of the finger follower assembly 54 allows the shaft 56 to rotate and translate along the slots 70 so as to effect advantageous alignment of the components of the valvetrain 36 by ensuring proper engagement between the bearing 58 and the lobe 50 of the camshaft 28 independent of the engagement of the pad 62 with the valve 38 and the engagement of the socket 64 with the lash adjuster 52. Thus, skew occurring in operation is compensated for which might otherwise be caused by misalignment of one or more components of the valvetrain 36, or which might otherwise be present in a conventional finger follower assembly itself. As such, the finger follower assembly 54 of the present invention significantly reduces the cost and complexity of manufacturing and assembling the valvetrain 36. Further, it will be appreciated that the present invention affords opportunities for superior engine 20 operational characteristics, such as improved performance, component life and longevity, efficiency, weight, load and stress capability, and packaging orientation.

The invention has been described in an illustrative manner. It is to be understood that the terminology which has been used is intended to be in the nature of words of description rather than of limitation. Many modifications and variations of the invention are possible in light of the above teachings. Therefore, within the scope of the appended claims, the invention may be practiced other than as specifically described.

What is claimed is:

1. A finger follower assembly for use in an internal combustion engine valvetrain having a valve, a lash adjuster, and a camshaft having a lobe; said finger follower assembly comprising:

a shaft;

a bearing rotatably supported by said shaft for engaging the lobe of the camshaft; and a body having:

a pad for engaging the valve, a socket spaced longitudinally from said pad for engaging the lash adjuster, a pair of walls spaced laterally from each other and disposed between said pad and said socket, and a slot formed in each of said walls for supporting said shaft, each of said slots having a respective pair of opposed, open-ended eccentric arc-shaped bearing surfaces, and a pair of transition bearing surfaces arranged longitudinally between and merging with said arc-shaped bearing surfaces, said transition bearing surfaces of each of said slots disposed parallel and opposed to each other, said open-ended eccentric arc-shaped bearing surfaces and said pair of transition bearing surfaces cooperating to allow said shaft to rotate within said slots and to move along said slots so as to facilitate alignment of said bearing with respect to engagement with the lobe of the camshaft independent of alignment of said pad with respect to engagement with the valve and of alignment of said socket with respect to engagement with the lash adjuster.

2. The finger follower assembly as set forth in claim 1, wherein said shaft extends between shaft ends with a retainer formed at each of said shaft ends arranged to restrict lateral movement of said shaft along said slots.

3. The finger follower assembly as set forth in claim 1, wherein each of said arc-shaped bearing surfaces has a constant radius of curvature.

4. The finger follower assembly as set forth in claim 3, wherein each of said slots has a slot width defined longitudinally between said arc-shaped bearing surfaces, said slot width being greater than four times the radius of curvature of the arc-shaped bearing surfaces.

5. The finger follower assembly as set forth in claim 3, wherein said pair of arc-shaped bearing surfaces of each of said slots are further defined as a first arc-shaped bearing surface and a second arc-shaped bearing surface; and wherein said first arc-shaped bearing surface of each of said slots has a first center of curvature, and said second arc-shaped bearing surface of each of said slots has a second center of curvature spaced from said first center of curvature.

6. The finger follower assembly as set forth in claim 5, wherein said first centers of curvature are spaced from said socket at a first center distance and said second centers of curvature are spaced from said socket at a second center distance greater than said first center distance.

7. The finger follower assembly as set forth in claim 5, wherein said first centers of curvature of said first arc-shaped bearing surfaces are spaced from said second centers of curvature of said second arc-shape bearing surfaces at a slot distance, said slot distance being less than said radius of curvature.

8. The finger follower assembly as set forth in claim 7, wherein said slot distance is between 10 and 500 microns.

9. The finger follower assembly as set forth in claim 7, wherein said slot distance is between 50 and 300 microns.

* * * * *